US006530644B2

(12) United States Patent
Premnath et al.

(10) Patent No.: US 6,530,644 B2
(45) Date of Patent: Mar. 11, 2003

(54) METHOD AND APPARATUS FOR CLEANING FLUID EJECTION CARTRIDGE AND MAINTENANCE STATION

(75) Inventors: Karai P. Premnath, Rochester, NY (US); Thomas J. Trenchard, Farmington, NY (US); Leonard M. Carreira, Penfield, NY (US); Donald P. Curran, Jr., Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/847,275

(22) Filed: May 3, 2001

(65) Prior Publication Data

US 2002/0163556 A1 Nov. 7, 2002

(51) Int. Cl.[7] ..... B41J 2/165

(52) U.S. Cl. ..... 347/35; 347/28; 347/86

(58) Field of Search ..... 347/28, 21, 85, 347/86, 100, 30, 95, 22, 29, 84, 35; 15/320; 400/701, 702, 702.1

(56) References Cited

U.S. PATENT DOCUMENTS

| | | | | |
|---|---|---|---|---|
| 5,634,170 A | | 5/1997 | Knapp et al. | 399/29 |
| 5,825,380 A | * | 10/1998 | Ichizawa et al. | 347/28 |
| 5,917,512 A | * | 6/1999 | Weber et al. | 347/28 |

* cited by examiner

*Primary Examiner*—Shih-Wen Hsieh
(74) *Attorney, Agent, or Firm*—Oliff & Berridge, PLC

(57) ABSTRACT

An improved method of upgrading an image transfer engine such as, for example, an ink jet fluid printer or plotter using liquid ink, or a xerographic device using a liquid toner is disclosed. A removable ink flush tank/cartridge containing an ink cleaner is substituted for a removable ink tank, permitting complete cleaning of ink from the ink fluid flow paths in the engine. This results in less contamination of new inks with previously used inks in the engine.

12 Claims, 2 Drawing Sheets

METHOD AND APPARATUS FOR CLEANING FLUID EJECTION CARTRIDGE AND MAINTENANCE STATION

BACKGROUND OF THE INVENTION

1. Field of Invention

This invention relates to fluid ejection systems having fluid ejection heads and replaceable fluid supply cartridges.

2. Description of Related Art

Fluid ejection systems, such as, for example, ink jet fluid printers and plotters, have a fluid ejection head with a fluid supply, either integral with the fluid ejection head, or connected to the fluid ejection head. A fluid ejection head contains a plurality of fluid channels that carry fluid from the fluid supply, such as, for example, a fluid supply cartridge, to respective fluid ejecting nozzles. A maintenance/capping station is often provided in such fluid ejection systems. At the end of an ejection operation, the fluid supply cartridge and fluid ejection head face are placed opposite the maintenance/capping station. The maintenance/capping station includes a capping chamber and an associated suction pump communicating through a waste tank and conduit lines. The capping chamber is movable into and away from the fluid ejection head. The capping chamber is used to prime the fluid ejection head with fluid when connected to the fluid ejection head and suction is applied to draw fluid through the fluid ejection head openings, as well as to remove dried fluid, contaminants and gas bubbles from the fluid ejection head.

Fluid ejection systems, such as ink jet printers and plotters, typically use four different color fluids, such as, for example, the three subtractive primary colors of cyan, yellow and magenta, and the achromatic color black. Ink jet printers and plotters may use different numbers of ink supply cartridges, such as, for example, four separate ink supply cartridges or two ink fluid supply cartridges, one having three compartments for the primary color inks, and the other ink tank having black ink. Alternatively, one tank with four compartments may be provided for the four different color inks.

If the user of a fluid ejection system, such as an ink jet printer or plotter, changes an ink color or type of ink being used in the fluid ejection system, such as, for example, a change from certain subtractive primary inks to pantone color or photographic color inks, if the new ink is incompatible with the old ink, the quality of the printed product or printed image will be decreased, often to the point of being unfit for its intended use. One way to avoid ink incompatibility problems is to insure that new inks are backward compatible with older inks or different types of ink. Unfortunately, this is not always possible.

U.S. Pat. No. 5,634,170 to Knapp et al. discloses a method and apparatus for filtering and sensing a developer fluid in a printing or copying machine to ensure that developer fluid reclaimed from a developing process is free from contamination. In col. 7, lines 34–45, Knapp et al. teaches an advantage of having a filtering station when the color of toner at a developing station is changed to another color of toner, for example, when a specialty of custom color toner has been used in a developer housing and is replaced with another color toner. Knapp et al. points out that it is very important that the reclaimed fluid be free of the first color of toner so that the second color of toner is not contaminated with the first color of toner, especially when a dark colored toner is replaced with a light color toner. Knapp et. al also teaches a toner sump cleaning mode in col. 12, lines 5–17, where cleaned reclaimed fluid is circulated through the filtering/sensing process until the fluid in the toner sump is free from toner. Then another color toner can be added to the toner concentration holding station. Knapp et al. also teaches having cleaned fluid travel to the diluent holding station rather than to the toner sump when desired.

SUMMARY OF THE INVENTION

This invention provides systems and methods that allow incompatible fluids to be used in a fluid ejection system.

This invention separately provides systems and methods for flushing a fluid ejection head connected to a removable fluid supply tank.

This invention further provides systems and methods that flush a fluid ejection head using a fluid supply tank containing a flushing fluid.

This invention also provides systems and methods that flush a fluid ejector head using at least two distinct fluids contained in at least two fluid supply tanks that are separately used to flush the fluid ejector head.

This invention also conditions the fluid injector head and a maintenance/capping station of a fluid ejection system to fluids distinct from existing and/or previously used fluids.

The systems and methods according to this invention provide a simple, easy-to-use cleaning technique for fluid ejection systems, including ink jet printers, which does not involve a separate toner concentration holding station, a diluent holding station with separate diluent supply lines, a toner sump, or elaborate sensing equipment.

The systems and methods according to this invention modify known fluid supply cartridges by filling one or more of such fluid supply tanks with one or more of a flushing fluid an ejection-fluid ink miscible fluid, such that the fluid supply tanks become flush tanks. Depending on the composition of the original ejection fluid relative to the composition of the new or replacement ejection fluid, more than one flush fluid may be required to achieve an effective flushing of the old fluid from the fluid ejection system. In various exemplary embodiments, in situations where more than one flush fluid is required, one flush fluid may be used to flush the original ejection fluid from the fluid ejection head and/or the maintenance/cap mechanism of the fluid ejection system. The second flush fluid is then used to condition the fluid ejection head and/or the maintenance/capping station for the new ejection fluid.

In various exemplary embodiments, the fluid ejection systems and methods according to this invention employ a fluid ejection head that accommodates different ejection fluid supply tanks. In this case, a flush tank is loaded into the fluid ejection head in the same manner as the standard ejection fluid supply tanks. When the fluid ejection system is an ink jet printer, for example, the flush tank contains a colorless, or slightly tinted, fluid so that the flush tank can be distinguished from an ink supply tank. The flush tank cleaning and conditioning fluids are used to clean the fluid ejection head and/or the capping/maintenance station components. The waste tank portion of the capping/maintenance station is used to collect all fluids ejected into the maintenance/capping station, whether one or more fluid ejection heads are used. The fluid receiving caps and the fluid lines to the waste tank portion of the capping/maintenance station can also be cleaned using the flush fluids These and other features of the invention are described in, or are apparent from, the following detailed description of various exemplary embodiments of the systems and methods according to this invention.

BRIEF DESCRIPTION OF THE DRAWINGS

Various exemplary embodiments of this invention will be described in detail, with reference to the following figures, wherein.

DETAILED DESCRIPTION OF EXEMPLARY EMBODIMENTS

The following detailed description of various exemplary embodiments of the fluid ejection systems according to this invention are in part directed to one specific type of fluid ejection system, an ink jet fluid printer, for sake of clarity and familiarity. However, it should be appreciated that the principles of this invention, as outlined and/or discussed below, can be equally applied to any known or later-developed fluid ejection systems, beyond the ink jet fluid printer specifically discussed herein.

Figure 1:
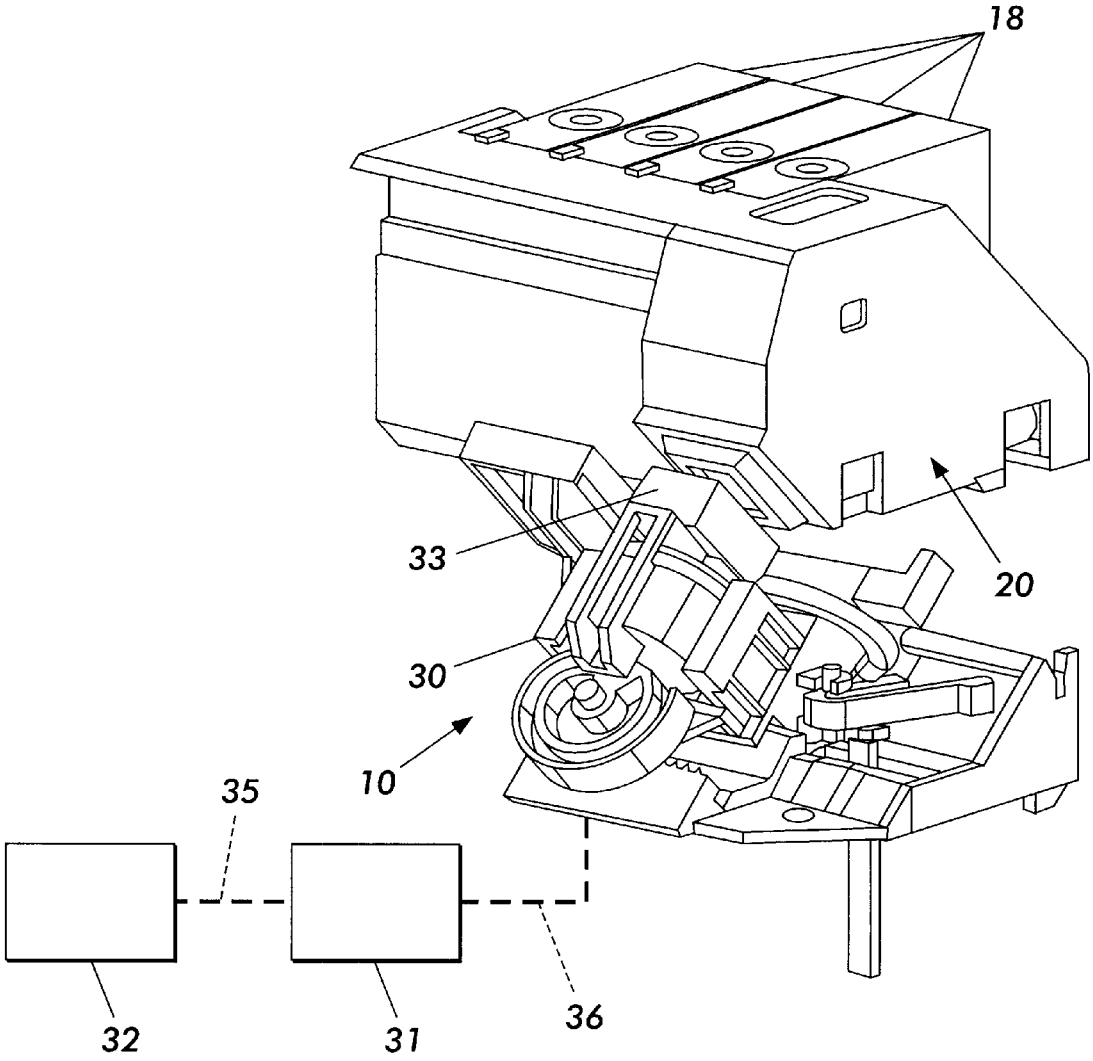
FIG. 1 is a perspective view of a conventional ink jet fluid printer having a printhead and a capping/maintenance station.

FIG. 1 shows one exemplary embodiment of an ink jet printer 10 that uses one or more ink supply containers 18 connected to the fluid ejector 20. The ink jet printer 10 also includes a capping/maintenance station 30 that includes a cap chamber 33 usable to cap fluid ejector 20. At the end of a fluid ejection operation, the scanning carriage (not shown) is parked in a maintenance position confronting the maintenance station 30. The maintenance station includes a chamber 33 and an associated suction pump 32 in communication with each other through a waste tank 31. The fluid lines 35 and 36 interconnect the interior of the chamber 33 with the waste ink tank 31 and the waste ink tank 31 with the suction pump 32, respectively. The chamber 33 is movable toward and away from the fluid ejection head 20.

Routine maintenance performed to clean debris, including dried ink and other materials, from each fluid ejector 20 is performed by covering each fluid ejector 20 with the corresponding cap of the capping/maintenance unit 30. Ink flows through the fluid ejector 20. Contaminants, including contaminated ink, are collected in the capping maintenance unit 30 and are drained by suction from the suction pump 32 into the waste ink tank 31. The capping/maintenance station unit 30 may be used to cap the fluid ejector 20 when the ink jet printer 10 is idle, to reduce evaporation from, and drying of, ink in the fluid ejector 20.

As an ink cleaning liquid, the flush fluid may be made up of one or more ink solvents without ink dye or pigment particles, or contain such low amounts of ink so as to constitute an indicator of the type ink with which the cleaning liquid is to be used, but not enough ink to materially contaminate other inks to be used later in the printer 10. The ink cleaning liquid may contain surfactants and/or chelating agents that allow adsorbed contaminants and deposits to be relatively easily removed from the fluid ejector 20 and from other fluid passageways in the ink jet printer 10. When used by a customer, the flush fluid supply cartridges are installed in the fluid ejector 20 in place of the original ink tanks 18.

The user then operates the ink jet printer 10 to clean the fluid circuit of the ink jet printer 10. A fluid circuit "clean" function may be performed directly with a user interface of the ink jet printer 10 such as, for example a touch screen, indirectly via a self-contained separate controller, or via a separate computer such as, for example, a personal computer. The "clean" function flushes old, incompatible ink from the fluid ejector 20 and the maintenance/cap station 30 so that, ideally, all vestiges of "old" incompatible ink are removed. For example, when a user wants to install ink fluid supply cartridges which contain ink which is not fully compatible with the previously or currently installed ink supply tanks, the "clean" function may be performed through a user interface to clean the fluid ejector 20 and the cap/maintenance station 30 and the associated fluid conduits.

Figure 2:
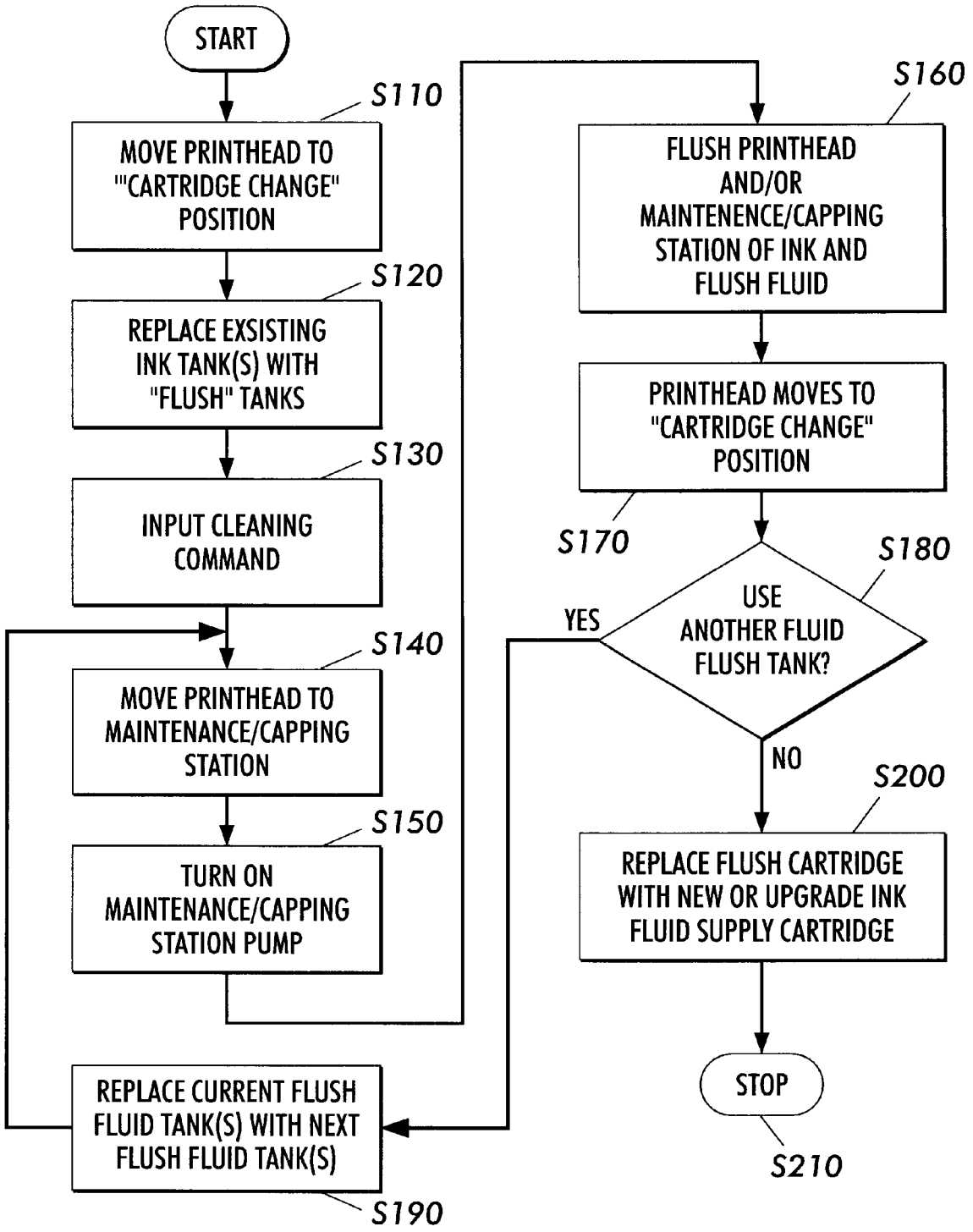
FIG. 2 is flowchart outlining one exemplary embodiment of a method for flushing a fluid ejector according to this invention.

FIG. 2 shows a flowchart outlining one exemplary embodiment of a method for flushing a fluid ejector head according to this invention. A user starts the flush operation. A flush operation can be started by, for example, selecting a start operation activator, such as, for example, a push button or touch screen portion located on the printer. Alternatively such a selection may be made by way of a display on a personal computer device, or by any other suitable interface with a printer controller.

The flush operation begins in step S100 and continues to step S110, where the fluid ejector 20 moves to a cartridge change position. Once the fluid ejector 20 is located at the position where the cartridge or ink tank 18 can be changed, that fact may be displayed on the printer or on an associated display, such, as for example, on a personal computer. Next, in step S120, the user then replaces one or more ink tanks 18 with one or more flush tanks. Once this is done, suitable sensing elements can signal that the flush tank(s) 18 have been inserted, and this information can also be displayed to a user. Then, in step S130, the user inputs a clean command to the printer directly or through a device, such as a computer, which is interfaced with the printer. Control then continues to step S140.

In step S140, the printer moves the fluid ejector 20 to the maintenance/capping station 30. Then in step S150, the maintenance/capping station 30 pump is turned on. This can be done manually by the user via a button or other input device on the printer or via an interfaced computer, or it can be done automatically by the printer as part of a sequence of system flush commands. Next in step S160, the suction pump 32 flushes the fluid ejector 20 and/or the maintenance station 30, including any fluid lines connecting the fluid ejector 20 and the maintenance station 30, the waste ink tank 31 and the fluid lines 35 and 36 in the ink jet printer. Control then continues to step S170.

Flushing the fluid ejector 20 and/or these other elements can be accomplished by operating the flush pump for a predetermined amount of time, by flushing with a predetermined volume of cleaning fluid, and/or by real-time sensing a suitable parameter of the fluid, such as, for example, the optical density or electrical capacitance of the flushing fluid. In the last case, sensors (not shown) would be provided to detect a suitable parameter, such as, for example, the optical density or the electrical impedance or conductivity, of the ink flushed from the capping/maintenance station 30 and/or fluid ejection head 20. These sensors would provide one or more signals to the printer to shut off the suction pump 32 to terminate the flush operation when a desired flush fluid characteristic is achieved. When the flush operation has been performed, the printer may indicate that the flush operation is completed by displaying, for example, a "flush complete" message or other suitable message.

In step S170, the fluid ejector 20 is moved to the cartridge change position. This can be done automatically or manually. Next, in step S180, a determination is made whether a second or subsequent flush cartridge 18 needs to be used. This determination can be made automatically, based on the user identifying the name or identifier of the new ejection fluid composition to be used, or in any other known or later-developed manner. Alternatively, this determination can be made manually, by prompting the user with a query regarding whether there is another flush cartridge 18 to be installed.

If another flush fluid supply cartridge 18 is to be installed, control continues to step S190, where the next flush cartridge is installed in place of the previous flush cartridge. Control then jumps back to step S140. In contrast, if not, control jumps to step S200, where the user replaces the current flush ink fluid supply cartridges 18 with new or upgrade ink fluid supply cartridges 18. The printer may indicate that the flush fluid supply cartridges 18 have been replaced by ink fluid supply cartridges, i.e., by sensing a characteristic of the ink tank(s), such as, for example, a bar code label or any other known or later-developed method for encoding information into or onto the ink fluid supply cartridges 18. Then, in step S210, once the replacement ink cartridge(s) have been inserted in place of the flush cartridges, the clean/flush operation is terminated. This may be accomplished automatically or manually. This operation results in an upgraded image transfer engine ready to use the new or upgraded ink without fear of contamination by the previously-used ink.

It should also be appreciated that the systems and methods of this invention can also be used with fluid ejection systems that do not have maintenance stations. In such fluid ejection systems, the fluid ejection heads are cleaned by firing fluid drops onto a receiving medium. This receiving medium is used in place of the waste fluid tank to receive and/or absorb the waste drops created during the cleaning process. This receiving medium is then discarded.

Likewise, in the systems and methods according to this invention, the flush fluid drops can be ejected onto a waste receiving medium in place of ejecting the flush fluid drops into the maintenance cap outlined above. In this case, only the fluid ejection head will need to be cleaned, and the maintenance station 30 and its various subsystems will be omitted. Likewise, steps S140 and S150 would be omitted, and step S160 would be modified to merely flush the fluid ejector head 20.

While this invention has been described in conjunction with the exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. A method of cleaning a fluid ejection system having at least one fluid ejection head, comprising:

removing a removable fluid supply tank containing a first ejection fluid from the fluid ejection head;

inserting a first removable flush fluid supply tank containing a flush fluid into the fluid ejection head;

passing the flush fluid from the removable flush fluid supply tank through the fluid ejection head to flush the first ejection fluid from the fluid ejection head; removing the removable flush fluid supply tank from the fluid ejection head;

inserting a second removable flush fluid supply tank containing a second flush fluid in place of the first removable flush fluid supply tank in the fluid ejection head; and passing the second flush fluid from the second removable flush fluid supply tank through the fluid ejection head to flush the second ejection fluid from the fluid ejection head.

2. The method of claim 1, further comprising:

removing the second removable flush fluid supply tank from the fluid ejection head; and inserting another removable fluid supply tank containing a second ejection fluid in place of the second removable flush fluid supply tank into the fluid ejection head.

3. The method of claim 1, wherein passing the flush fluid through the fluid ejector head comprising using the flush fluid from the removable flush tank to flush the first ejection fluid from fluid passages and fluid containing components of the fluid ejection system.

4. The method of claim 1, wherein the fluid ejection system is an ink jet printer.

5. The method of claim 1, wherein the flush fluid is ejected onto a waste recovery medium.

6. The method of claim 1, further comprising controlling the flush fluid ejection using real-time sensing of a fluid parameter.

7. The method of claim 1, further comprising controlling the flush fluid ejection by operating a flush pump for a predetermined amount of time.

8. A method of changing a set of at least one ejection fluid ejectable by a fluid ejection system to a different set of at least one ejection fluid, the fluid ejection system initially having at least one fluid ejection head, a first set of at least one removable fluid supply tank installed in the fluid ejection heat, each removable fluid supply tank containing of the first set containing one of the set of at least one ejection fluid, and a capping/maintenance station, the method comprising:

replacing at least one of the first set of at least removable ejection fluid supply tank with at least one flush fluid tank containing a cleaning fluid;

placing the at least one fluid ejection head relative to the capping/maintenance station; and operating the capping/maintenance station to withdraw from the fluid ejection head the cleaning fluid from the at least one removable flush fluid supply tank;

removing the at least one flush fluid tank from the fluid ejection system; and replacing the at least one removed flush fluid tank with at least one flush fluid supply tank that contains a flush fluid different from the replaced at least one of the first set of at least one removable supply tank to form a second set of at least one removable flush fluid supply tank installed in the fluid ejection head, the second set containing the different set of fat least one flush fluid.

9. The method of claim 8, further comprising operating the capping/maintenance station to clean the capping/maintenance station with the cleaning fluid withdrawn from the at least one removable flush fluid supply tank.

10. The method of claim 8, further comprising:

passing the second flush fluid from the second removable flush fluid supply tank through the fluid ejection head to flush the second ejection fluid from the fluid ejection head.

11. The method of claim 10, further comprising:

removing the second removable flush fluid supply tank from the fluid ejection head; and inserting another removable fluid supply tank containing another ejection fluid into the fluid ejection head.

12. The method of claim 8, further comprising replacing the at least one removed flush fluid tank with at least one flush fluid supply tank that contains a flush fluid different from the replaced at least one of the first set of at least one removable supply tank to form a second set of at least one removable flush fluid supply tank installed in the fluid ejection head, the second set containing the different set of at least one flush fluid.

* * * * *